US005693900A

United States Patent [19]

Calato et al.

[11] Patent Number: 5,693,900

[45] Date of Patent: Dec. 2, 1997

[54] BASS DRUM MALLET

[75] Inventors: Joseph S. Calato, Youngstown; Richard T. Catanese, Lewiston, both of N.Y.

[73] Assignee: J.D. Calato Mfg. Co. Inc., Niagara Falls, N.Y.

[21] Appl. No.: 703,092

[22] Filed: Aug. 26, 1996

[51] Int. Cl.[6] ..... G10D 13/02

[52] U.S. Cl. ..... 84/422.4; 84/452 P

[58] Field of Search ..... 84/422.4, 422.1, 84/422.2, 452 P

[56] References Cited

U.S. PATENT DOCUMENTS

| | | | |
|---|---|---|---|
| 2,040,603 | 3/1936 | Gladstone | 84/422.4 |
| 4,386,549 | 6/1983 | Shinneman | 84/422.4 |
| 4,541,322 | 9/1985 | Calato | 84/422.4 |
| 4,632,006 | 12/1986 | Ambroszewski | 84/422.4 |
| 5,361,671 | 11/1994 | Genna | 84/422.4 |

*Primary Examiner*—Cassandra C. Spyrou
*Attorney, Agent, or Firm*—James F. Mudd

[57] ABSTRACT

Moisture proof and wear resistant mallet heads are made of polyurethane foam. The mallet heads are substantially spherical in shape, and are attached to the handle by an aluminum sleeve that fits over a portion of the handle have a reduce diameter. The product is an improvement over the use of mallets with felt heads which readily deteriorate when exposed to moisture and wear. The products of the invention are known for their strength that is reflected in their durability and wearability.

9 Claims, 2 Drawing Sheets

BASS DRUM MALLET

BACKGROUND OF INVENTION

Mallets used with bass drams are currently manufactured with mallet heads or beater balls made of felt. However, such mallet heads or beater balls deteriorate when exposed to wear and moisture, particularly when exposed to rain. This is a special problem for bass drums used by marching bands. Accordingly, there is a need for moisture resistant and wear resistant bass drum mallets.

SUMMARY OF THE INVENTION

In accordance with the invention, moisture resistant and wear resistant bass drum mallet heads are made of a polyurethane material, preferably a polyurethane foam. Such mallet heads are also referred to as beater balls. The mallet heads or beater balls of the invention are substantially spherical in shape.

A preferred polyurethane foam useful in the invention is a microporous polyester polyurethane foam. Such a foam material is sold under the trade name ACCUFLO polyurethane by Porelon Group, located in Cookeville, Tenn. The foam has a molded density of about 25 to 40 pounds per cubic foot, preferably about 32 pounds per cubic foot. The foam has a Durometer hardness value in the range of about 40 to about 60 on the Shore A scale.

The polyurethane foams that form the head of the bass drum mallet of the invention are passed through an extruder that produces a hollow plastic cylinder. The extruded hollow plastic cylinder of polyurethane is cut to the desired thickness. The resulting product which has been extruded and cut has a hole through the center along the central axis and is circular in shape. The circular product can be machined to have a substantially spherical shape. The machining step may be used to remove all or part of a skin layer that results from the extrusion step.

The resulting polyurethane foams that form the head of the bass drum mallet of the invention are attached to a suitable handle by a procedure disclosed in U.S. Pat. No. 4,541,322, the disclosure of which is incorporated herein by reference.

The mallet of the invention is assembled from a narrow handle that can have a reduced diameter at one end, and a metal sleeve having a diameter smaller than the main portion of the handle but larger than the reduced diameter portion of the handle. The metal sleeve is inserted over the portion of the mallet handle that has a narrow or reduced diameter. One end of the sleeve that is closer to the main handle has a rolled end or flange. The sleeve can be attached to the wooden handle with staples or other means. Then the polyurethane foam that has been machined to a substantially spherical shape is inserted over the sleeve. The other end of the sleeve that is farther from the main handle is rolled over to form a flange to help hold the mallet head on the handle.

The mallet handles are preferably made of wood, but can also be made of: aluminum, fiber glass, graphite, or composite materials, such as fiber glass reinforced plastics such as polyesters.

The sleeve is preferably made of aluminum. Other metals such as stainless steel can also be used.

Polyether polyurethane foam as well as polyether polyurethane can be employed in the invention.

Other methods can be used for assembling the components of the invention. Such methods include gluing the components together.

DETAILED DESCRIPTION OF DRAWINGS

Figure 1:
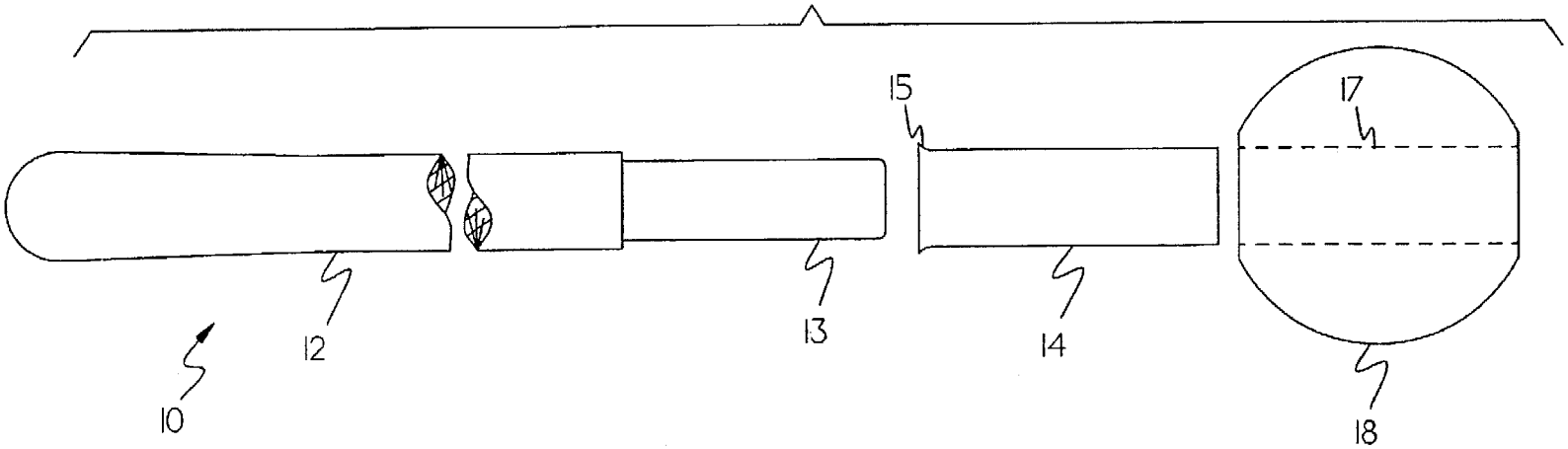
FIG. 1 shows an exploded view of the bass drum mallet of the invention.

FIG. 1 shows an exploded view of the bass drum mallet of the invention 10. Handle 12 is preferably circular in cross-section. Handle 12 may have a portion 13 having a reduced diameter. Sleeve 14 is thin walled, circular in cross-section and has one end rolled over to form a flange 15. The foamed polyurethane beater ball 18 is shown with hole 17.

Figure 2:
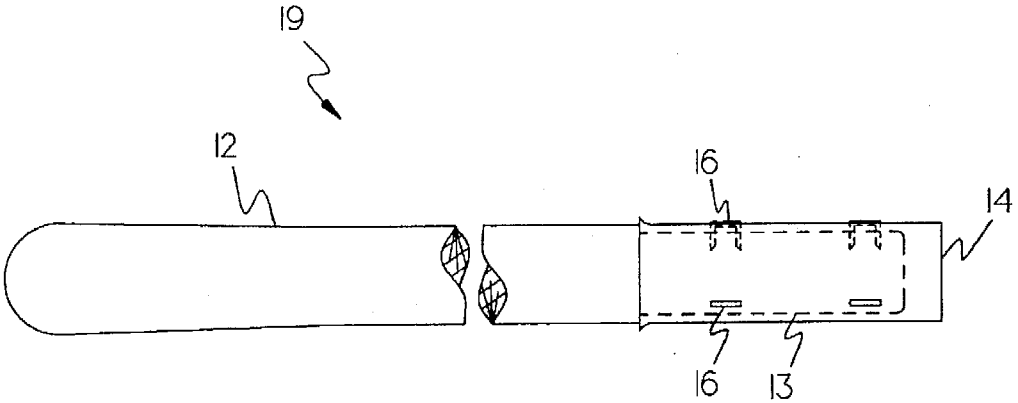
FIG. 2 shows an assembled view of the bass drum handle assembly.

FIG. 2 shows an assembled view of the bass drum mallet handle assembly 19. Sleeve 14 is attached to the portion 13 having a reduced diameter compared to handle 12, and is attached with the aid of staples 16.

Figure 3:
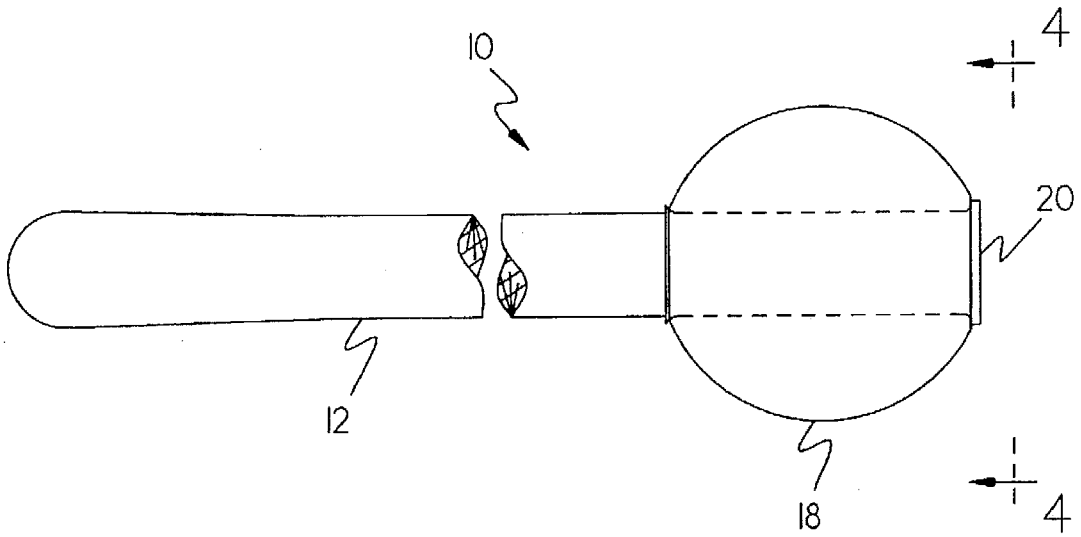
FIG. 3 shows the beater ball or mallet head of the invention attached to the bass drum handle.

FIG. 3 shows the beater ball 18 attached to aluminum sleeve 14 and held on the sleeve 14 by rolled over end or flange 20.

Figure 4:
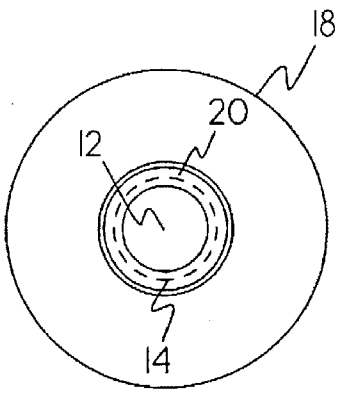
FIG. 4 generally along lines 4—4 of FIG. 3.

FIG. 4 is a view generally along lines 4—4 of FIG. 3. This view shows handle 12, aluminum sleeve 14 with flange 20 and polyurethane beater ball 18.

DETAILED DESCRIPTION OF THE INVENTION

The outer diameter of the beater ball is in the range of about 0.5 to 6 inches. The inside hole has a diameter of about ⅜ to 1.5 inches.

The handles of the mallet of the invention are generally about 10 to 20 inches in length. The handles of the invention are generally about 0.5 to one inch in diameter. One end of the handle can have a smaller diameter than the main body of the handle. The small diameter is about 50 to 95 percent of the diameter of the main body of the handle.

The metal sleeve can have an inside diameter slightly smaller than the reduced diameter portion of the handle which results in a press fit. The outside diameter of the metal sleeve is slightly larger than the inside diameter of the polyurethane beater ball.

The metal sleeve may be attached to the narrowed portion of the handle with the aid of conventional metal staples. Other methods of attachment can be used.

EXAMPLES

Four samples of the same polyurethane foam material sold under the trade name ACCUFLO polyurethane by Porelon Group. were tested for use in the invention.

The foamed polyurethane material was ground down to produce a substantially spherical foam product. The dimensions of the polyurethane foam are given in Table 1. The products were tested for hardness and shown to have the hardness values give in Table 1.

TABLE 1

| Sample Number | Weight Grams | Diameter Inches | Width Inches | Bandwidth (a) Inches | Hardness Shore A Scale |
|---|---|---|---|---|---|
| 1 | 43–46 | 2.220 | 2.100 | None (b) | 45–50 |
| 2 | 68 | 2.272 | 2.115 | 1.830 | 55 |
| 3 | 62 | 2.270 | 2.115 | 1.485 | 55 |
| 4 | 57 | 2.270 | 2.115 | 1.075 | 55 |

(a) Bandwidth is a measure of the amount of skin that remains after machining the edge of the polyurethane foam that has been extruded
(b) The polyurethane foam is machined to a spherical shape such that there is no remaining edge.

The products of the invention are known for their moisture resistance and water resistance. The products of the invention are known for their strength that is reflected in their durability and wearability.

We claim:

1. A bass drum mallet comprising a handle and a mallet head attached to said handle, said mallet head comprising a polyurethane foam.

2. The bass drum mallet of claim 1 wherein the polyurethane foam is a polyester polyurethane foam.

3. The bass drum mallet of claim 1 wherein the polyurethane foam is essentially spherical in shape.

4. The bass drum mallet of claim 3 wherein the polyurethane foam has a Durometer hardness value in the range of about 40 to about 60 as measured on the Shore A scale.

5. The bass drum mallet of claim 4 wherein the polyurethane foam has a molded density in the range of about 25 to 40 pounds per cubic foot.

6. The bass drum mallet of claim 5 wherein the polyurethane foam is comparable in weight to a felt mallet head of the same size.

7. The bass drum mallet of claim 6 wherein the strength of the bass drum mallet is not adversely affected by water or moisture.

8. The bass drum mallet of claim 7 wherein the mallet is not adversely affected by water.

9. The bass drum mallet of claim 7 wherein the mallet is not adversely affected by wear.

* * * * *